US010658095B2

(12) United States Patent
Sakazaki et al.

(10) Patent No.: US 10,658,095 B2
(45) Date of Patent: May 19, 2020

(54) SM-FE-N MAGNET MATERIAL AND SM-FE-N BONDED MAGNET

(71) Applicant: DAIDO STEEL CO., LTD., Nagoya-shi (JP)

(72) Inventors: Iwao Sakazaki, Nagoya (JP); Takefumi Sugiyama, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 338 days.

(21) Appl. No.: 15/701,085

(22) Filed: Sep. 11, 2017

(65) Prior Publication Data

US 2018/0082771 A1 Mar. 22, 2018

(30) Foreign Application Priority Data

Sep. 16, 2016 (JP) ..... 2016-181262

(51) Int. Cl.

| | |
|---|---|
| ***H01F 1/059*** | (2006.01) |
| ***H01F 1/055*** | (2006.01) |
| ***C22C 33/02*** | (2006.01) |
| ***H01F 41/02*** | (2006.01) |
| ***C22C 38/00*** | (2006.01) |
| ***B22F 9/04*** | (2006.01) |
| ***B22F 1/00*** | (2006.01) |

(52) U.S. Cl.

CPC ..... *H01F 1/059* (2013.01); *C22C 33/0278* (2013.01); *C22C 38/005* (2013.01); *H01F 1/0551* (2013.01); *H01F 1/0558* (2013.01); *H01F 41/0253* (2013.01); *B22F 1/0062* (2013.01); *B22F 9/04* (2013.01); *B22F 2009/048* (2013.01); *B22F 2998/10* (2013.01); *B22F 2999/00* (2013.01); *H01F 41/0266* (2013.01)

(58) Field of Classification Search

CPC ..... C22C 38/005; H10F 1/059; H10F 1/0533
See application file for complete search history.

(56) References Cited

U.S. PATENT DOCUMENTS 5,716,462 A 2/1998 Sakurada et al.
5,968,290 A * 10/1999 Sakurada ..... H01F 1/059 148/301

(Continued)

FOREIGN PATENT DOCUMENTS

CN 1195868 A 10/1998
CN 1196144 C 4/2005

(Continued)

OTHER PUBLICATIONS

Translation for JP 2006-183151, dated Jul. 13, 2006.*

(Continued)

*Primary Examiner* — C Melissa Koslow
(74) *Attorney, Agent, or Firm* — McGinn I. P. Law Group, PLLC.

(57) ABSTRACT

The present invention relates to an Sm—Fe—N magnet material including: 7.0-12 at % of Sm; 0.1-1.5 at % of at least one element selected from the group consisting of Hf, Zr, and Sc; 0.1-0.5 at % of Mn; 10-20 at % of N; and 0-35 at % of Co, with the remainder being Fe and unavoidable impurities. The present invention also relates to an Sm—Fe—N bonded magnet including a powder of the Sm—Fe—N magnet material and a binder.

12 Claims, 3 Drawing Sheets

(56) References Cited

U.S. PATENT DOCUMENTS

| | | | |
|---|---|---|---|
| 2001/0054453 | A1 | 12/2001 | Sakurada et al. |
| 2002/0014283 | A1 | 2/2002 | Iriyama et al. |
| 2004/0144450 | A1 | 7/2004 | Iriyama et al. |
| 2015/0318089 | A1 | 11/2015 | Li |

FOREIGN PATENT DOCUMENTS

| | | | | |
|---|---|---|---|---|
| CN | 102468028 | A | | 5/2012 |
| JP | H 06-020813 | A | | 1/1994 |
| JP | H06-244013 | A | | 9/1994 |
| JP | H 09-07006 | A | | 3/1997 |
| JP | H 11-003812 | A | | 1/1999 |
| JP | H11-87118 | A | | 3/1999 |
| JP | 2000-357606 | A | | 12/2000 |
| JP | 2002-057017 | A | | 2/2002 |
| JP | 3455557 | B2 | | 10/2003 |
| JP | 2006-183151 | | * | 7/2006 |
| JP | 2006-183151 | A | | 7/2006 |
| JP | 2016-526298 | A | | 9/2016 |

OTHER PUBLICATIONS

Korean Office Action dated May 11, 2018 in corresponding Korean Application No. 10-2017-0118580 with an English translation thereof.

Ryo Omatsuzawa et al., "Structure and Magnetic Properties of SmFeN Prepared by Rapid-Quenching Method", DENKI-SEIKO (Electric Furnace Steel), Daido Steel Co., Ltd., vol. 73, No. 4, pp. 235-242, published in Oct. 2002.

Chinese Office Action, dated Feb. 25, 2019, in Chinese Application No. 201710822051.6 and English Translation thereof.

Extended European Search Report dated Feb. 13, 2018 in European Application No. 17191126.6.

Japanese Office Action dated Mar. 17, 2020 in Japanese Patent Application No. 2016-181262 with an English translation.

* cited by examiner

SM-FE-N MAGNET MATERIAL AND SM-FE-N BONDED MAGNET

FIELD OF THE INVENTION

The present invention relates to an Sm—Fe—N (samarium-iron-nitrogen) magnet and an isotropic Sm—Fe—N bonded magnet suitable for use in applications where small size, small thickness, or complicated shape is required.

BACKGROUND OF THE INVENTION

At present, Nd—Fe—B (neodymium-iron-boron) magnets are mainly used as permanent magnets for applications where high magnetic force (maximum energy product) is required. However, Sm—Fe—N magnets are known as magnets which are superior in property to the Nd—Fe—B magnets (Patent Document 1 and Non-Patent Document 1). Sm—Fe—N magnets have the merits of being comparable in saturation magnetic polarization to the Nd—Fe—B magnets and higher in anisotropic magnetic field and Curie temperature than the Nd—Fe—B magnets and being less apt to oxidize and rust.

In general, powders for use as raw materials for magnets are classified by magnetism into isotropic magnet powders and anisotropic magnet powders. The term "isotropic magnet powder" means a powder in which each of the alloy powder particles is configured of a large number of fine crystal grains and the directions of easy magnetization of the individual crystal grains are random. Meanwhile, the term "anisotropic magnetic powder" means a powder in which each of the alloy powder particles is a single crystal or in which each of the alloy powder particles is configured of a large number of crystal grains and the directions of easy magnetization of the individual crystal grains in each particle have been oriented in a specific direction. The Sm—Fe—N alloy powders mainly include: isotropic magnet powders in which the main phase thereof has a hexagonal crystal structure that is metastable and is called the $TbCu_7$ type and which is obtained, for example, by a melt-quench method; and anisotropic magnet powders in which the main phase thereof has a rhombohedral crystal structure called the $Th_2Zn_{17}$ type and is a stable phase.

The crystals which constitute Sm—Fe—N magnets decompose upon heating to a temperature exceeding about 500° C. Because of this, Sm—Fe—N magnets cannot be produced as sintered magnets, for which heating to a temperature around 1,000° C. is necessary during the production, and are used as bonded magnets. In general, a bonded magnet is produced by mixing a magnet powder and a binder and molding the resultant compound with a compression molding machine, injection molding machine, or the like. The bonded magnets hence are inferior in magnetic flux density to the sintered magnets by an amount corresponding to the presence of the binder and voids, but have a merit in that bonded magnets which are small or thin or have a complicated shape can be easily obtained. Furthermore, isotropic Sm—Fe—N bonded magnets produced from powders of $TbCu_7$-type isotropic magnets are low in maximum energy product as compared with anisotropic Sm—Fe—N bonded magnets produced from powders of $Th_2Zn_{17}$-type anisotropic magnets, but have an advantage in that since there is no need of applying a magnetic field during the molding, the production efficiency is high and the freedom of designing magnetization patters is high. Owing to the merits of such isotropic bonded magnets and those merits of the Sm—Fe—N magnets (high anisotropic magnetic field, high Curie temperature, and low susceptibility to oxidation and rusting), isotropic Sm—Fe—N bonded magnets are used in, for example, automotive motors that are used in severe environments.

Patent Document 1: JP-A-2002-057017

Non-Patent Document 1: Ryo Omatsuzawa, Kimitoshi Murashige, and Takahiko Iriyama, "Structure and Magnetic Properties of SmFeN Prepared by Rapid-Quenching Method", DENKI-SEIKO (Electric Furnace Steel), Daido Steel Co., Ltd., Vol. 73, No. 4, pp. 235-242, published in October, 2002

SUMMARY OF THE INVENTION

In general, a magnet which has been magnetized decreases in magnetic flux density as the temperature rises. In cases when the temperature which has temporarily been heightened declines to room temperature, the magnet does not completely recover the original magnetic flux density although partly recovering the magnetic flux density. Such a decrease in magnetic flux density which occurs upon heating from room temperature is referred to as "thermal demagnetization"; and that part of the thermal demagnetization by which the magnetic flux density recovers upon cooling to room temperature is referred to as "reversible demagnetization" and the part which remains unrecovered is referred to as "irreversible demagnetization". In cases when a plurality of magnets are to be examined for change in magnetic flux density over a long period, it is difficult to measure the magnetic flux of a magnet which is held at a predetermined temperature higher than room temperature. Because of this, a method is generally employed in which a magnet is held at a predetermined temperature for a predetermined time period and thereafter cooled to room temperature and examined for magnetic flux to evaluate this magnet in terms of irreversible demagnetization. In general, a value obtained by dividing the difference between the "magnetic flux after demagnetization" and the "magnetic flux after magnetization and before demagnetization" by the latter magnetic flux is called "demagnetizing factor". In particular, a value obtained by dividing the difference between the "magnetic flux measured after temperature rise and subsequent return to room temperature (after demagnetization)" and the "magnetic flux measured at room temperature after magnetization and before temperature rise (before demagnetization)" by the latter magnetic flux is called "irreversible demagnetizing factor". According to the definitions in this specification, the demagnetizing factor and the irreversible demagnetizing factor have negative values.

In an ordinary magnet, the magnetic flux density decreases (the magnet is demagnetized) at a relatively high rate over the period when the temperature rises and reaches a predetermined temperature, but the magnetic flux density gradually decreases (the magnet is gradually demagnetized) also during the period when the magnet is held at that temperature over a long period. Since it is difficult to measure the magnetic flux of the magnet in a heated state as stated above, the demagnetization which occurs during the period when the magnet is heated to a predetermined temperature is evaluated using an initial demagnetizing factor determined from the magnetic flux measured when the magnet which was held at that predetermined temperature for 1 hour has been returned to room temperature. In this specification, the demagnetization which occurs during the period when the magnet is held at a predetermined temperature over a long period is evaluated using the decrease amount of an irreversible demagnetizing factor from the initial demagnetizing factor, the irreversible demagnetizing factor being determined from the magnetic flux measured when the magnet which was held at that predetermined temperature over the long period has been returned to room temperature.

The conventional Sm—Fe—N bonded magnets kept being heated show a lower degree of demagnetization with the lapse of time than Nd—Fe—B bonded magnets. However, the irreversible demagnetizing factor thereof, for example, due to 2,000-hour holding at 120-150° C. in the air is lower than the initial demagnetizing factor by as large as 2% or more. In order for an Sm—Fe—N bonded magnet to be used in a high-temperature environment over a long period, the bonded magnet needs to be inhibited, as much as possible, from suffering such demagnetization.

An object of the present invention is to provide an Sm—Fe—N magnet material and an Sm—Fe—N bonded magnet which are isotropic ($TbCu_7$ type) and are suitable for long-term use in high-temperature environments.

Namely, the present invention relates to the following items (1) to (5).

(1) An Sm—Fe—N magnet material including:

7.0-12 at % of Sm;

0.1-1.5 at % of at least one element selected from the group consisting of Hf, Zr, and Sc;

0.1-0.5 at % of Mn;

10-20 at % of N; and 0-35 at % of Co, with the remainder being Fe and unavoidable impurities.

(2) The Sm—Fe—N magnet material according to (1), further including 0.1-0.5 at % of Si.

(3) The Sm—Fe—N magnet material according to (1) or (2), further including 0.1-0.5 at % of Al.

(4) The Sm—Fe—N magnet material according to any one of (1) to (3), in which a main phase thereof has a $TbCu_7$-type crystal structure.

(5) An Sm—Fe—N bonded magnet including a powder of the Sm—Fe—N magnet material according to any one of (1) to (4) and a binder.

As will be described later, the present inventors made an experiment in which Sm—Fe—N magnet materials were held in a high-temperature environment (120° C. in this experiment) in the air for a long period. As a result, the following were ascertained. In the case of Sm—Fe—N magnet materials having a content of Mn less than 0.1 at % or having a content of Mn exceeding 0.5 at %, the absolute value of the decrease amount of the irreversible demagnetizing factor as measured after holding over a sufficiently long time period (2,000 hours in this experiment) from the initial demagnetizing factor was larger than 2.2%. In contrast, in the case of Sm—Fe—N magnet materials each having a content of Mn within the range of 0.1-0.5 at %, the absolute value of the decrease amount was 2.2% or less. Thus, according to the Sm—Fe—N magnet material of the present invention, since Mn is contained therein in an amount of 0.1-0.5 at %, this magnet material is inhibited from fluctuating in magnetic flux density with the lapse of time in a high-temperature environment (inhibited from suffering thermal demagnetization) and has been stabilized. As a result, a material for magnets suitable for long-term use in high-temperature environments is obtained.

The at least one element (hereinafter referred to as element T) selected from the group consisting of Hf, Zr, and Sc is an element added in order to obtain a $TbCu_7$-type structure. Furthermore, by replacing some of the Fe atoms with Co, the saturation magnetization can be heightened and the Curie temperature can be elevated to improve the heat resistance. However, in case where the content of Co in the Sm—Fe—N magnet material exceeds 35 at %, the saturation magnetic flux density and the residual magnetization undesirably decrease, rather than increase. Consequently, the content of Co is 35% or less.

The Sm—Fe—N magnet material according to the present invention can contain, as unavoidable impurities, O (oxygen) and H (hydrogen) each in an amount of up to 0.3 at % and Cr (chromium), Ni (nickel), and Cu (copper) each in an amount of up to 0.1 at %. Furthermore, the Sm—Fe—N magnet material according to the present invention may contain C (carbon) in an amount of up to 0.5 at %. Any Sm—Fe—N magnet material which contains these elements in amounts within the respective ranges is included in the present invention so long as the magnet material includes Sm, element T, Mn, N, Fe, and Co in amounts within the respective ranges described above (Co may not be contained).

For showing the contents of the elements, different effective digits have been used for the elements. In cases when the content of an element was able to be determined with an accuracy higher than the effective digits, the measured value is rounded off to the effective digits by correcting the digit succeeding the effective digits. In the case where the value thus obtained is within that range, this content satisfies the requirement according to the present invention. For example, in the case where the content of Mn is determined with an accuracy down to the second decimal place and the measured value is 0.05 at %, the measured value is rounded off by correcting the digit in the second decimal place to give "0.1 at %", which is within the range. Consequently, the measured value satisfies the requirement concerning Mn content.

It is desirable that the Sm—Fe—N magnet material according to the present invention includes Si (silicon) in an amount of 0.1-0.5 at %. Thus, the thermal demagnetization can be further diminished. Likewise, the thermal demagnetization of the Sm—Fe—N magnet material according to the present invention can be further diminished also by incorporating Al (aluminum) thereinto in an amount of 0.1-0.5 at %. In these cases, the Sm—Fe—N magnet material according to the present invention may contain either Si or Al in an amount of 0.1-0.5 at %, or may contain both Si and Al in an amount of 0.1-0.5 at % each.

The Sm—Fe—N bonded magnet according to the present invention includes a powder of the Sm—Fe—N magnet material according to the present invention and a binder.

According to the present invention, it is possible to obtain an Sm—Fe—N magnet material and an Sm—Fe—N bonded magnet which are isotropic ($TbCu_7$ type) and are suitable for long-term use in high-temperature environments.

DETAILED DESCRIPTION OF THE INVENTION

Figure 1:
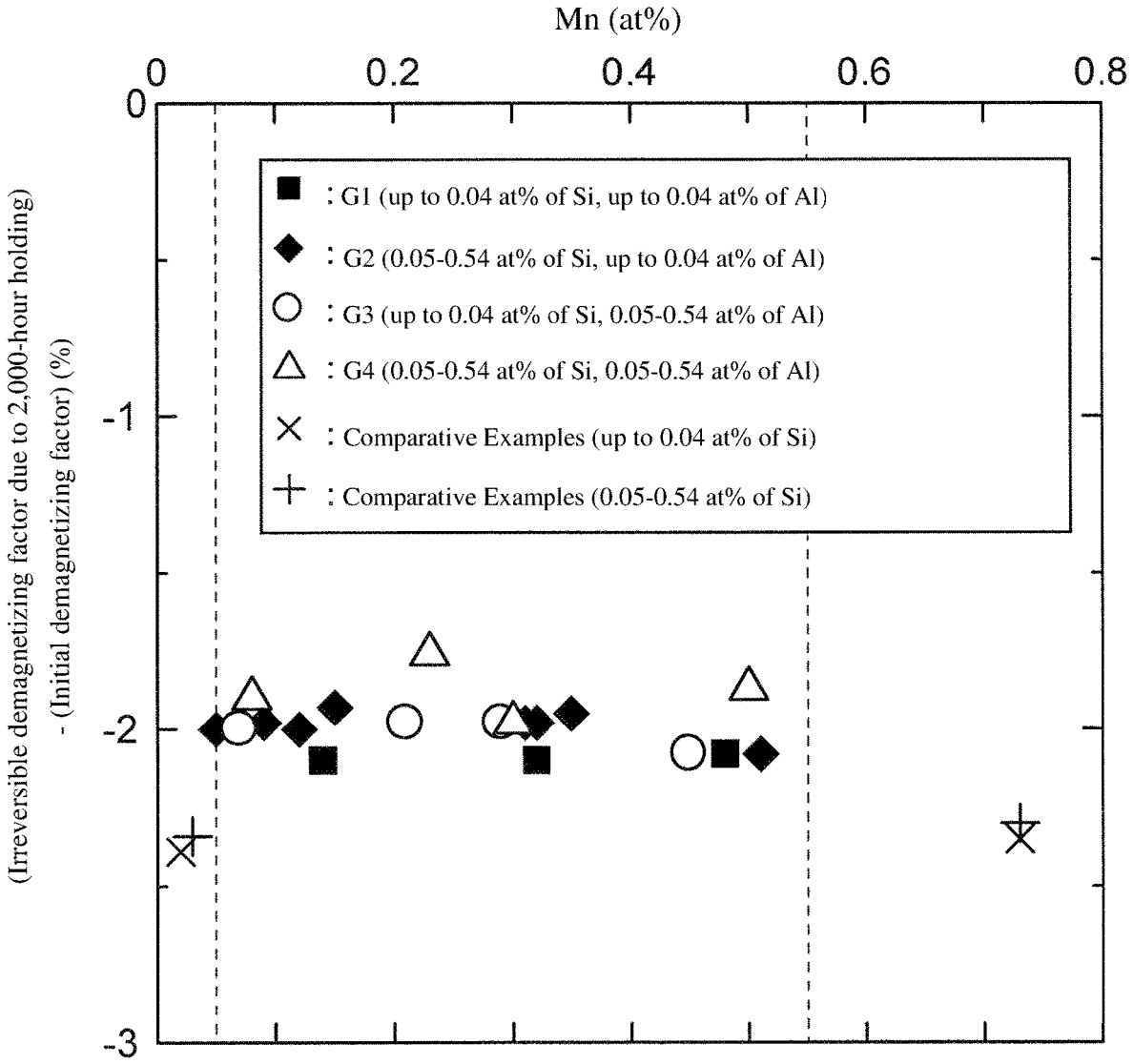
FIG. 1 is a graph that shows the decrease amounts of irreversible demagnetizing factors due to 2,000-hour holding at 120° C. from the initial demagnetizing factors, with respect to a plurality of samples differing in Mn content in Examples of the Sm—Fe—N bonded magnets according to the present invention and Comparative Examples.

Embodiments of the Sm—Fe—N magnet material and Sm—Fe—N bonded magnet according to the present invention are explained below.

The Sm—Fe—N magnet material of the present invention includes: 7.0-12 at % of Sm; 0.1-1.5 at % of at least one element (element T) selected from the group consisting of Hf, Zr, and Sc; 0.1-0.5 at % of Mn, 10-20 at % of N, and 0-35 at % of Co, with the remainder being Fe and unavoidable impurities. This Sm—Fe—N magnet material can be produced, for example, by the following method.

First, the components shown above, excluding N, are mixed together and melted to thereby produce a melt serving as a raw material. Next, this melt is jetted to the surface of a roll which is rotating at a high speed, thereby rapidly cooling the melt to produce a ribbon of an alloy. This ribbon is heat-treated in an inert atmosphere at a temperature in the range of 700-800° C. to thereby change some of the amorphous and metastable phases into a stable phase. This operation is conducted in order to enable the alloy to have a higher coercive force after the subsequent nitriding.

Thereafter, the ribbon is heated in a gas which contains molecules having nitrogen atoms to thereby obtain nitrided powder. This operation heightens the saturation magnetization, coercive force, and maximum energy product. A mixed gas containing ammonia and hydrogen is suitable for use as the gas containing molecules including nitrogen atoms. In this example, ammonia gas is the gas including molecules including nitrogen atoms. The heating temperature and pressure in the nitriding depend on the gas used. In an example, in cases when a gas containing ammonia and hydrogen in a volume ratio of 1:3 is used, a heating temperature of about 450° C. is used and the pressure is regulated to substantially atmospheric pressure (slightly higher than atmospheric pressure) by performing the treatment while passing the gas through the tube furnace. By regulating the time period of this nitriding, the content of N is regulated to 10-20 at %. Through the operations shown above, a powder-form Sm—Fe—N magnet material (hereinafter referred to as "Sm—Fe—N magnet powder") is obtained.

As stated above, the Sm—Fe—N magnets generally include ones in which the main phase thereof has a $Th_2Zn_{17}$-type crystal structure and ones in which the main phase thereof has a $TbCu_7$-type crystal structure. In this embodiment, an Sm—Fe—N magnet powder in which the main phase thereof has a $TbCu_7$-type crystal structure is obtained by incorporating element T in an amount of 0.1-1.5 at %.

In the Sm—Fe—N magnet powder according to this embodiment, it is possible to further incorporate Si in an amount of 0.1-0.5 at % or to further incorporate Al in an amount of 0.1-0.5 at %. In the case of incorporating Si and/or Al, an Sm—Fe—N magnet powder may be produced in the same manner as described above. By incorporating Si and/or Al into the Sm—Fe—N magnet powder according to this embodiment, the Sm—Fe—N magnet produced from this Sm—Fe—N magnet powder can be more effectively inhibited from suffering thermal demagnetization over a long period than in the case where neither of the two elements is contained.

The Sm—Fe—N bonded magnet according to this embodiment can be produced by mixing the Sm—Fe—N magnet powder produced by the method described above with a binder and molding the mixture. As the binder, use can be made of a thermosetting resin such as an epoxy resin or a thermoplastic resin such as a nylon. For example, the Sm—Fe—N magnet powder according to the embodiment described above is mixed with 2% by mass of an epoxy resin, and this mixture is compression-molded. Thus, an Sm—Fe—N bonded magnet according to this embodiment is obtained.

EXAMPLES

Shown below are the results of an experiment in which Sm—Fe—N bonded magnets were actually produced and examined for magnetic property. In this experiment, an epoxy resin was added in an amount of 2% by mass to each of Sm—Fe—N magnet powders containing the respective elements in amounts shown in Table 1. Each mixture was kneaded, compression-molded into a cylinder having a diameter of 10 mm and a height of 7 mm, and then hardened. Thus, Sm—Fe—N bonded magnets were produced. Although the contents of Fe are omitted in Table 1, Fe accounts for the remainder of each magnet. In Table 1, nineteen samples of Examples have been sorted into four groups, G1 to G4, by the contents of Si and Al. In group G1, the contents of Si and Al are each 0.04 at % or less (less than 0.1 at % when the content values are rounded off by correcting the digits in the second decimal place). In group G2, the content of Si is 0.05-0.54 at % (0.1-0.5 at % when the content values are rounded off likewise), and the content of Al is 0.04 at % or less. In group G3, the content of Si is 0.04 at % or less, and the content of Al is 0.05-0.54 at %. In group G4, the contents of Si and Al are each 0.05-0.54 at %. The samples of Comparative Examples are ones in each of which the content of Mn is 0.04 at % or less or is 0.55 at % or higher (the content is less than 0.1 at % or exceeds 0.5 at %, when rounded off by correcting the digit in the second decimal place).

TABLE 1

| | | | | | | T | | | | | |
|---|---|---|---|---|---|---|---|---|---|---|---|
| | | Sm | Co | N | Mn | Zr | Hf | Sc | Si | Al | C |
| G1 | Example 1 | 7.37 | 3.83 | 13.6 | 0.14 | 1.02 | — | — | 0.04 | 0.04 | 0.08 |
| | Example 2 | 7.16 | 3.80 | 13.4 | 0.32 | 0.96 | — | — | 0.04 | 0.03 | 0.10 |
| | Example 3 | 7.54 | 3.82 | 13.2 | 0.48 | 0.97 | — | — | 0.03 | 0.03 | 0.12 |
| G2 | Example 4 | 7.29 | 3.76 | 13.3 | 0.05 | 1.01 | — | — | 0.12 | 0.03 | 0.06 |
| | Example 5 | 7.30 | 3.81 | 13.2 | 0.15 | 1.05 | — | — | 0.28 | 0.02 | 0.06 |
| | Example 6 | 7.44 | 3.79 | 13.5 | 0.31 | 0.99 | — | — | 0.52 | 0.04 | 0.04 |
| | Example 7 | 7.42 | 3.82 | 13.6 | 0.32 | 0.98 | — | — | 0.10 | 0.03 | 0.06 |
| | Example 8 | 7.30 | 3.82 | 13.3 | 0.35 | 1.41 | — | — | 0.21 | 0.03 | 0.04 |

TABLE 1-continued

| | | Sm | Co | N | Mn | T Zr | Hf | Sc | Si | Al | C |
|---|---|---|---|---|---|---|---|---|---|---|---|
| | Example 9 | 7.42 | 3.81 | 13.1 | 0.09 | — | 1.52 | — | 0.18 | 0.04 | 0.03 |
| | Example 10 | 7.35 | 3.83 | 13.7 | 0.12 | — | — | 1.28 | 0.22 | 0.04 | 0.04 |
| | Example 11 | 7.41 | 3.77 | 13.4 | 0.51 | 0.95 | — | — | 0.48 | 0.03 | 0.33 |
| G3 | Example 12 | 7.48 | 3.77 | 13.4 | 0.29 | 0.68 | — | — | 0.02 | 0.07 | 0.08 |
| | Example 13 | 7.43 | 3.82 | 13.3 | 0.07 | 1.03 | — | — | 0.04 | 0.31 | 0.09 |
| | Example 14 | 7.38 | 3.83 | 13.5 | 0.21 | 1.13 | — | — | 0.03 | 0.42 | 0.11 |
| | Example 15 | 7.35 | 3.85 | 13.2 | 0.45 | 1.04 | — | — | 0.04 | 0.34 | 0.14 |
| G4 | Example 16 | 7.30 | 3.75 | 13.6 | 0.30 | 0.70 | — | — | 0.28 | 0.08 | 0.04 |
| | Example 17 | 7.39 | 3.73 | 13.5 | 0.08 | 1.11 | — | — | 0.42 | 0.28 | 0.06 |
| | Example 18 | 7.41 | 3.84 | 13.4 | 0.23 | 1.02 | — | — | 0.06 | 0.45 | 0.03 |
| | Example 19 | 7.45 | 3.81 | 13.4 | 0.50 | 1.01 | — | — | 0.49 | 0.32 | 0.25 |
| | Comparative Example 1 | 7.36 | 3.84 | 13.5 | 0.02 | 0.93 | — | — | 0.02 | 0.03 | 0.03 |
| | Comparative Example 2 | 7.32 | 3.82 | 13.6 | 0.73 | 0.97 | — | — | 0.02 | 0.04 | 0.06 |
| | Comparative Example 3 | 7.37 | 3.81 | 13.5 | 0.03 | 0.90 | — | — | 0.23 | 0.03 | 0.04 |
| | Comparative Example 4 | 7.37 | 3.76 | 13.2 | 0.73 | 1.03 | — | — | 0.43 | 0.04 | 0.05 |

G1: 0.05-0.54 at % of Mn, up to 0.04 at % of Si, up to 0.04 at % of Al
G2: 0.05-0.54 at % of Mn, 0.05-0.54 at % of Si, up to 0.04 at % of Al
G3: 0.05-0.54 at % of Mn, up to 0.04 at % of Si, 0.05-0.54 at % of Al
G4: 0.05-0.54 at % of Mn, 0.05-0.54 at % of Si, 0.05-0.54 at % of Al
Comparative Examples: up to 0.04 at % or at least 0.55 at % of Mn
* Note 1:
The contents are given in terms of at %.
* Note 2:
The content of each element is shown with three effective digits (down to the first decimal place for N; down to the second decimal place for the other elements).
* Note 3:
The remainder of each sample is Fe and unavoidable impurities.

The samples of the Examples and Comparative Examples were each subjected to an experiment in which the sample was examined for magnetic flux after magnetization and after the magnetized sample was held in a 120° C. oven for 1 hour or for 2,000 hours and then cooled to room temperature. The "initial demagnetizing factor" and "irreversible demagnetizing factor due to 2,000-hour holding" were determined from the data obtained. Furthermore, the decrease amount of the irreversible demagnetizing factor due to 2,000-hour holding from the initial demagnetizing factor (hereinafter, the decrease amount is referred to as "decrease amount through 2,000-hour holding") was determined as shown in FIG. 1 and Table 2.

TABLE 2

| | | Irreversible demagnetizing factor (%) | | Decrease amount of irreversible |
|---|---|---|---|---|
| | | Initial demagnetizing factor | Demagnetizing factor due to 2000-hour holding | Demagnetizing factor due to 2000-hour holding from Initial demagnetizing factor (%) |
| G1 | Example 1 | −6.68 | −8.78 | −2.10 |
| | Example 2 | −6.63 | −8.73 | −2.10 |
| | Example 3 | −6.63 | −8.71 | −2.08 |
| G2 | Example 4 | −6.70 | −8.70 | −2.00 |
| | Example 5 | −6.68 | −8.61 | −1.93 |
| | Example 6 | −6.63 | −8.61 | −1.98 |
| | Example 7 | −6.65 | −8.63 | −1.98 |
| | Example 8 | −6.67 | −8.62 | −1.95 |
| | Example 9 | −6.65 | −8.63 | −1.98 |
| | Example 10 | −6.66 | −8.66 | −2.00 |
| | Example 11 | −6.63 | −8.71 | −2.08 |

TABLE 2-continued

| | | Irreversible demagnetizing factor (%) | | Decrease amount of irreversible |
|---|---|---|---|---|
| | | Initial demagnetizing factor | Demagnetizing factor due to 2000-hour holding | Demagnetizing factor due to 2000-hour holding from Initial demagnetizing factor (%) |
| G3 | Example 12 | −6.63 | −8.61 | −1.98 |
| | Example 13 | −6.64 | −8.64 | −2.00 |
| | Example 14 | −6.64 | −8.62 | −1.98 |
| | Example 15 | −6.63 | −8.71 | −2.08 |
| G4 | Example 16 | −6.63 | −8.61 | −1.98 |
| | Example 17 | −6.40 | −8.30 | −1.90 |
| | Example 18 | −6.35 | −8.11 | −1.76 |
| | Example 19 | −6.38 | −8.25 | −1.87 |
| | Comparative Example 1 | −6.93 | −9.32 | −2.39 |
| | Comparative Example 2 | −6.75 | −9.10 | −2.35 |
| | Comparative Example 3 | −6.91 | −9.25 | −2.34 |
| | Comparative Example 4 | −6.86 | −9.16 | −2.30 |

It can be seen from the graph shown in FIG. 1 that the Examples (data indicated by the solid squares, solid rhombs, open circles, and open triangles) are smaller in decrease amount through 2,000-hour holding than the Comparative Examples (data indicated by the symbols × and +). Specifically, the decrease amounts through 2,000-hour holding in the Comparative Examples exceed 2.2%, whereas those in the Examples are 2.2% or less. This means that the Examples are higher in the stability of magnetic flux in high-temperature environments (i.e., thermal stability) and more suitable for long-term use in such environments than the Comparative Examples.

A comparison among the Examples in the graph of FIG. 1 shows that group G2 (solid rhombs) and group 3 (open circles) are smaller in decrease amount through 2,000-hour holding than group G1 (solid squares) and that group G4 (open triangles) are smaller in decrease amount through 2,000-hour holding than groups G2 and G3 (group G2 is substantially equal to group G3). This indicates that the thermal stability of Sm—Fe—N bonded magnets is enhanced by incorporating Si and/or Al thereinto in an amount of 0.05-0.54 at %. Meanwhile, among the Comparative Examples (Mn content: 0.04 at % or less), those containing 0.05-0.54 at % of Si (indicated by the symbol +) are each inferior in decrease amount through 2,000-hour holding to each of the Examples. It can hence be seen that Mn contributes more to thermal stability than Si.

Figure 2:
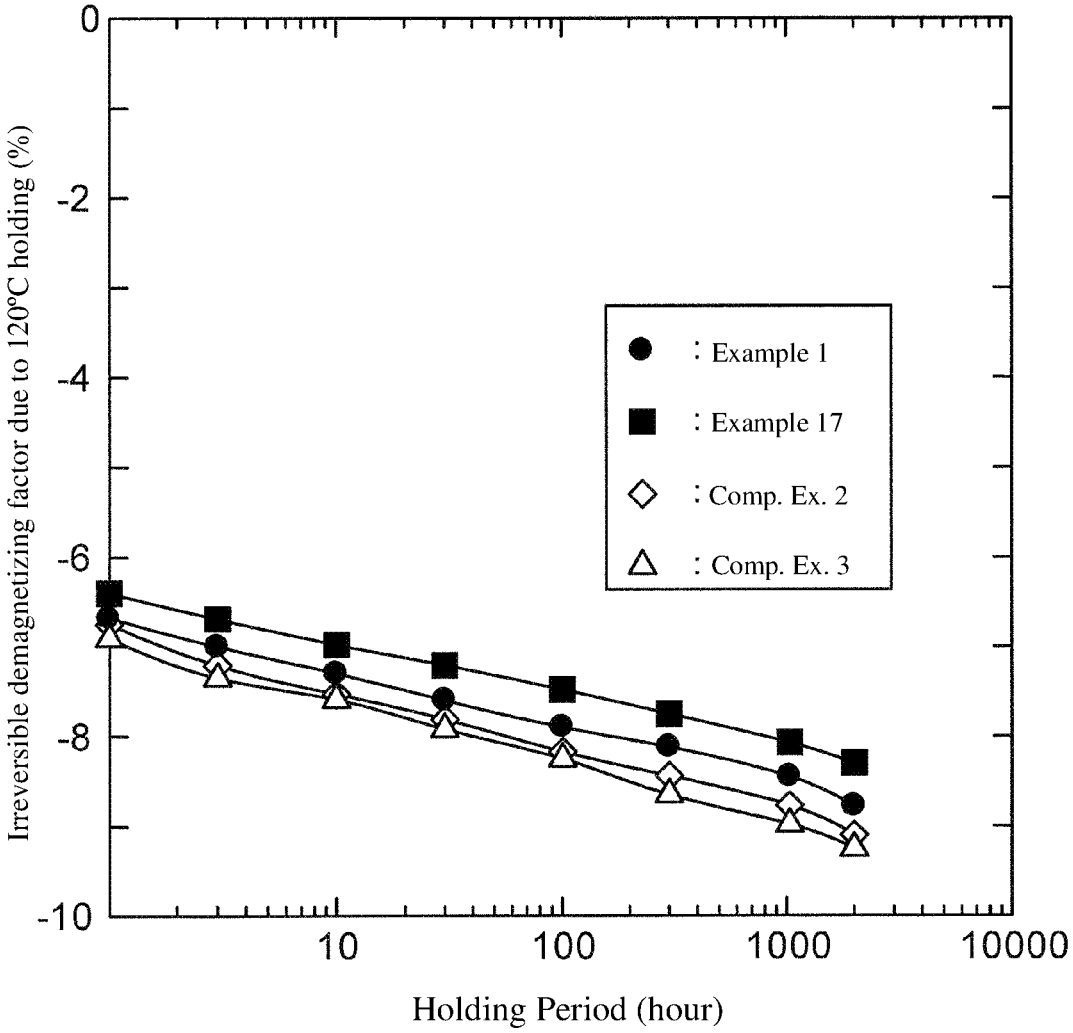
FIG. 2 is a graph that shows changes in irreversible demagnetizing factor with the lapse of time in holding at 120° C., in Examples according to the present invention and Comparative Examples.
Figure 3:
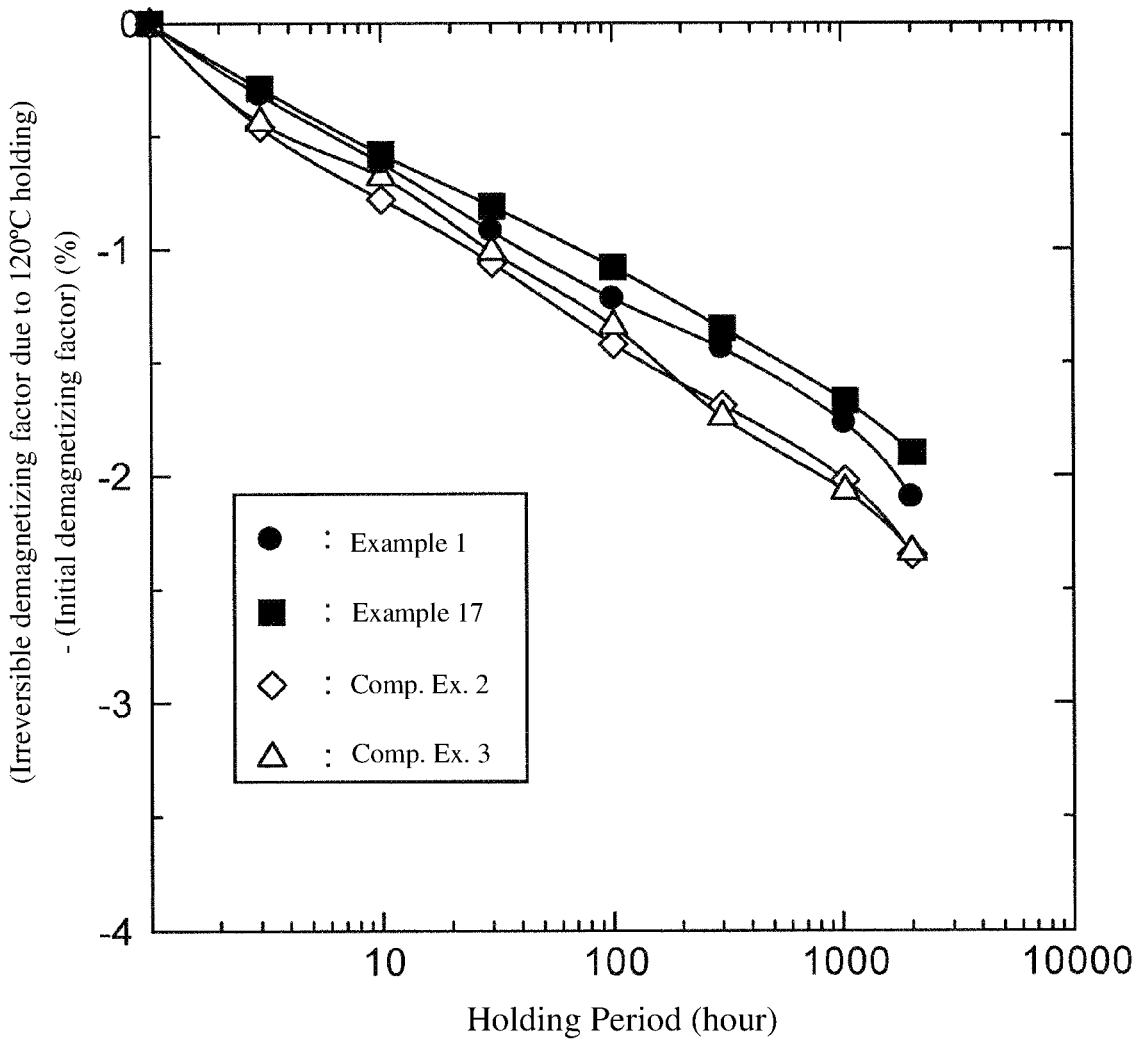
FIG. 3 is a graph that shows changes with the lapse of time in the decrease amounts of irreversible demagnetizing factors due to 120° C. holding from the initial demagnetizing factors in Examples according to the present invention and Comparative Examples.

FIG. 2 shows changes in irreversible demagnetizing factor with the lapse of time in holding at 120° C., with respect to the samples of Example 1, Example 17, Comparative Example 2, and Comparative Example 3. FIG. 3 shows changes with the lapse of time in the decrease amounts of irreversible demagnetizing factors due to 120° C. holding from the initial demagnetizing factors with respect to the same samples as in FIG. 2. Although demagnetization occurs at a relatively high rate during heating from room temperature to the holding temperature, it can be seen from the graphs of FIG. 2 and FIG. 3 that after the holding temperature has been reached, demagnetization occurs linearly with the logarithmic lapse of time. The samples of the Examples are smaller in the slope of the change in demagnetizing factor with the logarithmic lapse of time than the Comparative Examples. The same applies to the decrease amounts in irreversible demagnetizing factors from the initial demagnetizing factors. Thus, it can be seen also from the graphs of FIG. 2 and FIG. 3 that the Examples have better thermal stability than the Comparative Examples.

In Table 3 are shown the residual magnetic flux density $B_r$, coercive force $iH_c$, and maximum energy product $(BH)_{max}$ of each sample determined at room temperature. With respect to the $B_r$, $iH_c$, and $(BH)_{max}$, there is no significant difference between the Examples and the Comparative Examples. It was ascertained from these experimental results that, in the Sm—Fe—N bonded magnets of Examples, thermal stability which is higher than those of the Comparative Examples can be obtained while obtaining room-temperature coercive force $iH_c$ and room-temperature residual magnetic flux density $B_r$ which are substantially equal to those of the Comparative Examples. Irrespective of Examples or Comparative Examples, the decrease amount of an irreversible demagnetizing factor from the initial demagnetizing factor can be reduced by heightening the room-temperature coercive force $iH_c$ by suitably setting the conditions (temperature, time period) for the heat treatment of the powder. In this case, however, the residual magnetic flux density $B_r$ decreases undesirably.

TABLE 3

| | | $B_r$ (kG) | $iH_c$ (kOe) | $(BH)_{max}$ (kOe) |
|---|---|---|---|---|
| G1 | Example 1 | 7.78 | 9.54 | 12.9 |
| | Example 2 | 7.85 | 9.36 | 12.9 |
| | Example 3 | 8.02 | 9.44 | 13.2 |
| G2 | Example 4 | 8.02 | 9.53 | 13.5 |
| | Example 5 | 8.01 | 9.43 | 13.4 |

TABLE 3-continued

| | | $B_r$ (kG) | $iH_c$ (kOe) | $(BH)_{max}$ (kOe) |
|---|---|---|---|---|
| | Example 6 | 8.03 | 9.54 | 13.7 |
| | Example 7 | 8.02 | 9.36 | 13.3 |
| | Example 8 | 8.02 | 9.46 | 13.2 |
| | Example 9 | 7.98 | 9.45 | 13.1 |
| | Example 10 | 7.99 | 9.51 | 12.9 |
| | Example 11 | 8.04 | 9.55 | 13.5 |
| G3 | Example 12 | 8.03 | 9.43 | 13.1 |
| | Example 13 | 7.88 | 9.47 | 13.5 |
| | Example 14 | 7.96 | 9.51 | 12.9 |
| | Example 15 | 8.01 | 9.53 | 13.2 |
| G4 | Example 16 | 8.04 | 9.37 | 13.4 |
| | Example 17 | 8.12 | 9.41 | 13.6 |
| | Example 18 | 8.13 | 9.54 | 13.8 |
| | Example 19 | 8.10 | 9.49 | 13.7 |
| | Comparative Example 1 | 7.88 | 9.52 | 13.1 |
| | Comparative Example 2 | 7.98 | 9.41 | 13.4 |
| | Comparative Example 3 | 7.78 | 9.53 | 12.9 |
| | Comparative Example 4 | 8.09 | 9.46 | 13.8 |

The present application is based on Japanese patent application No. 2016-181262 filed on Sep. 16, 2016, and the contents of which are incorporated herein by reference.

What is claimed is:

1. An Sm—Fe—N magnet material, comprising:
7.0-12 at % of Sm;
0.1-1.5 at % of at least one element selected from the group consisting of Hf, Zr, and Sc;
0.1-0.5 at % of Mn;
10-20 at % of N,
0-35 at % of Co; and
0.1-0.5 at % of Si,
with a remainder being Fe and unavoidable impurities.

2. The Sm—Fe—N magnet material according to claim 1, further comprising 0.1-0.5 at % of Al.

3. The Sm—Fe —N magnet material according to claim 1, wherein a main phase thereof has a $TbCu_7$-type crystal structure.

4. The Sm—Fe—N magnet material according to claim 2, wherein a main phase thereof has a $TbCu_7$-type crystal structure.

5. An Sm—Fe—N magnet material, comprising:
7.0-12 at % of Sm;
0.1-1.5 at % of at least one element selected from the group consisting of Hf, Zr, and Sc;
0.1-0.5 at % of Mn;
10-20 at % of N,
0-35 at % of Co; and
0.1-0.5 at % of Al,
with a remainder being Fe and unavoidable impurities.

6. The Sm—Fe—N magnet material according to claim 5, wherein a main phase thereof has a $TbCu_7$-tape crystal structure.

7. An Sm—Fe—N bonded magnet comprising a powder of the Sm—Fe—N magnet material according to claim 1 and a binder.

8. An Sm—Fe—N bonded magnet comprising a powder of the Sm—Fe—N magnet material according to claim 2 and a binder.

9. An Sm—Fe—N bonded magnet comprising a powder of the Sm—Fe—N magnet material according to claim 3 and a binder.

10. An Sm—Fe—N bonded magnet comprising a powder of the Sm—Fe—N magnet material according to claim 4 and a binder.

11. An Sm—Fe—N bonded magnet comprising a powder of the Sm—Fe—N magnet material according to claim 5 and a binder.

12. An Sm—Fe—N bonded magnet comprising a powder of the Sm—Fe—N magnet material according to claim 6 and a binder.

* * * * *